US005261152A

United States Patent [19]

Simozaki et al.

[11] Patent Number: 5,261,152

[45] Date of Patent: Nov. 16, 1993

[54] METHOD FOR MANUFACTURING AMORPHOUS MAGNETIC CORE

[75] Inventors: Tsuneo Simozaki, Shibata; Mitsuo Kusano, Kitakanbara; Yukinori Taneda, Yokohama; Toshiyuki Sawaguchi, Shibata, all of Japan

[73] Assignees: Hitachi Ltd.; The Tokyo Electric Power Co., Inc., both of Tokyo, Japan

[21] Appl. No.: 858,513

[22] Filed: Mar. 27, 1992

[30] Foreign Application Priority Data

Mar. 29, 1991 [JP] Japan ..... 3-066047

[51] Int. Cl.[5] ..... H01F 41/02

[52] U.S. Cl. ..... 29/609; 336/234

[58] Field of Search ..... 29/609, 605, 606; 336/213, 216, 217, 234

[56] References Cited

U.S. PATENT DOCUMENTS 4,413,406 11/1983 Bennett et al. .

5,093,981 3/1992 Ballard et al. ..... 29/609

*Primary Examiner*—Carl E. Hall

*Attorney, Agent, or Firm*—Fay, Sharpe, Beall, Fagan, Minnich & McKee

[57] ABSTRACT

An amorphous magnetic core is arranged to be obtained by cutting a plurality of amorphous sheets to have a predetermined cut length by a cutter device and supplying the cut sheets to a rectangularly forming device, the sheets being supplied from an uncoiler device including a plurality of reels around which the sheets are wound, by winding the sheets of a predetermined number around a forming mandrel successively to form them into a rectangular shape, thereby forming the magnetic core, and by subjecting the magnetic core to magnetic annealing in an annealing device.

6 Claims, 9 Drawing Sheets

METHOD FOR MANUFACTURING AMORPHOUS MAGNETIC CORE

BACKGROUND OF THE INVENTION

1. Industrial Field of the Invention

The present invention relates to a method and apparatus for manufacturing a magnetic core for use in a transformer, and more particularly, to a method and apparatus for manufacturing a magnetic core made from amorphous magnetic sheet materials.

2. Description of the Prior Art

An amorphous magnetic material used for a magnetic core of a transformer has usually a very small thickness of, for example, 0.022 mm to 0.025 mm. Thus, a predetermined number of the amorphous magnetic sheets are superposed to have a predetermined thickness and bonded to one another, prior to being formed into a shape of a magnetic core.

For example, U.S. Pat. No. 4,413,406 discloses a method of manufacturing a core of an amorphous transformer using low temperature metal for bonding in which a bonding process is performed by using a metal of a low melting point.

This U.S. patent relates to a method which comprises the steps of: supplying from a plurality of reels the amorphous metal sheets wound therearound through an uncoiler in such a state that exposed surfaces of the supplied metal sheets from the reels are extending opposite face to face with each other; interposing a bonding metal material having a melting point of 50° C. to 350° C. between the opposite adjacent sheets; superposing a plurality of the amorphous metal sheets to form a compound sheet; heating the compound sheet at a temperature not less than the melting point of the bonding metal material; cooling the compound sheet for solidifying the molten bonding metal material to bond the plurality of amorphous metal sheets; cutting the compound sheet by a predetermined length; winding the cut compound sheet to form a core; and forming the wound core into a rectangular shape.

The prior art mentioned above has problems as follows:

(1) The cost of the material and investment in manufacturing equipment are too expensive because indium, bismuth, lead, cadmium, tin and the like are used as a bonding metal and such metals of low melting point are heated to bond the amorphous metal sheets. These metals are often harmful to humans, which results in a problem of environmental contamination.

(2) The conventional method requires some additional tedious steps of heating and cooling for the bonding material, so that the total number of the manufacturing steps is unnecessarily increased.

(3) Because the amorphous metal sheets are wound in such a manner that the bonding metal is partially interposed between the adjacent amorphous metal sheets, there occurs gaps between the adjacent sheets to deteriorate a space factor. A magnetic characteristic is thus decreased.

(4) In the conventional method, the amorphous metal sheets are formed into a core of a rectangular shape after they are once wound in a circular shape. The manufacturing steps are therefore increased in number. In this connection, a winding installment as well as a forming equipment are required for the manufacturing. And also, an installing space for this equipment is unfavorably enlarged. As a result, the manufacturing cost inevitably becomes high.

(5) A large amount of energy is consumed in such heating and cooling processes.

In view of the problems of the prior art, a primary object of the present invention is to provide a method and apparatus for manufacturing an amorphous magnetic core, by which an amorphous magnetic core having an improved closeness degree (in other words, the gap spaces in the core are reduced sufficiently in size) and an excellent magnetic characteristic can be obtained.

A second object of the invention is to provide a method and apparatus for manufacturing an amorphous magnetic core in which no bonding material is required, no heating energy for the bonding process is necessary, and in which the manufacturing process steps are reduced in number, thereby decreasing manufacturing and running cost.

A third object of the invention is to provide a method and apparatus for manufacturing an amorphous magnetic core in which heating, cooling and winding equipment is not required so that the installment occupation space can be minimized. The investment for the factory is thereby conspicuously decreased.

A fourth object of the invention is to provide a method and apparatus for manufacturing an amorphous magnetic core which can produce the amorphous magnetic core without using any harmful substances.

According to the invention, an amorphous magnetic core is manufactured by the steps of: uncoiling amorphous sheets from a plurality of reels around which the amorphous sheets are wound, respectively;

bringing the plurality of amorphous blank sheets into close contact with one another and cutting them in a superposed form by a predetermined length;

storing the cut amorphous sheets of a predetermined number in place, and supplying the stored amorphous sheets onto a rectangular mandrel;

directly forming the amorphous sheets of the predetermined number into a rectangular shape along a contour of the forming mandrel, thereby producing a rectangular magnetic core; and annealing the obtained rectangular magnetic core.

According to another aspect of the invention, there is provided a manufacturing apparatus for an amorphous magnetic core that comprises:

uncoiler means including a plurality of reels around each of which an amorphous blank sheet is wound, for uncoiling the amorphous blank sheets from the respective reels;

cutter means for bringing the plurality of amorphous sheets supplied from the uncoiler means into close contact with one another and cutting them in a superposed form by a predetermined length;

supply means for storing the cut amorphous sheets of a predetermined number, and supplying the stored amorphous sheets onto a rectangular forming mandrel;

rectangularly forming means for directly forming the amorphous sheets of the predetermined number into a rectangular shape along a contour of the forming mandrel, thereby producing a rectangular magnetic core; and means for annealing the rectangular magnetic core.

Advantageous effects of the present invention are as follows:

1. The obtained magnetic core is of a high closeness degree because the adjacent amorphous sheets can move freely during the forming step. Thus, the amorphous magnetic core is excellent in the magnetic properties.
2. Because the cut amorphous sheets are directly formed in the rectangular shape at a normal temperature, any specific bonding material and steps for bonding are not required, which results in a reduction of a cost for manufacturing the magnetic core. Energy of a heating efficiency is unnecessary, so economical process can be achieved. Further, equipment for bonding and sheet-winding circularly are not required, so that the investment of the installment is conspicuously decreased and the installment occupation space can be reduced.
3. The magnetic core can be manufactured only by the mechanical processing without using any toxic substances.

DESCRIPTION OF THE PREFERRED EMBODIMENT

One preferred embodiment of the present invention will be described hereinafter with reference to the drawings.

Figure 1:
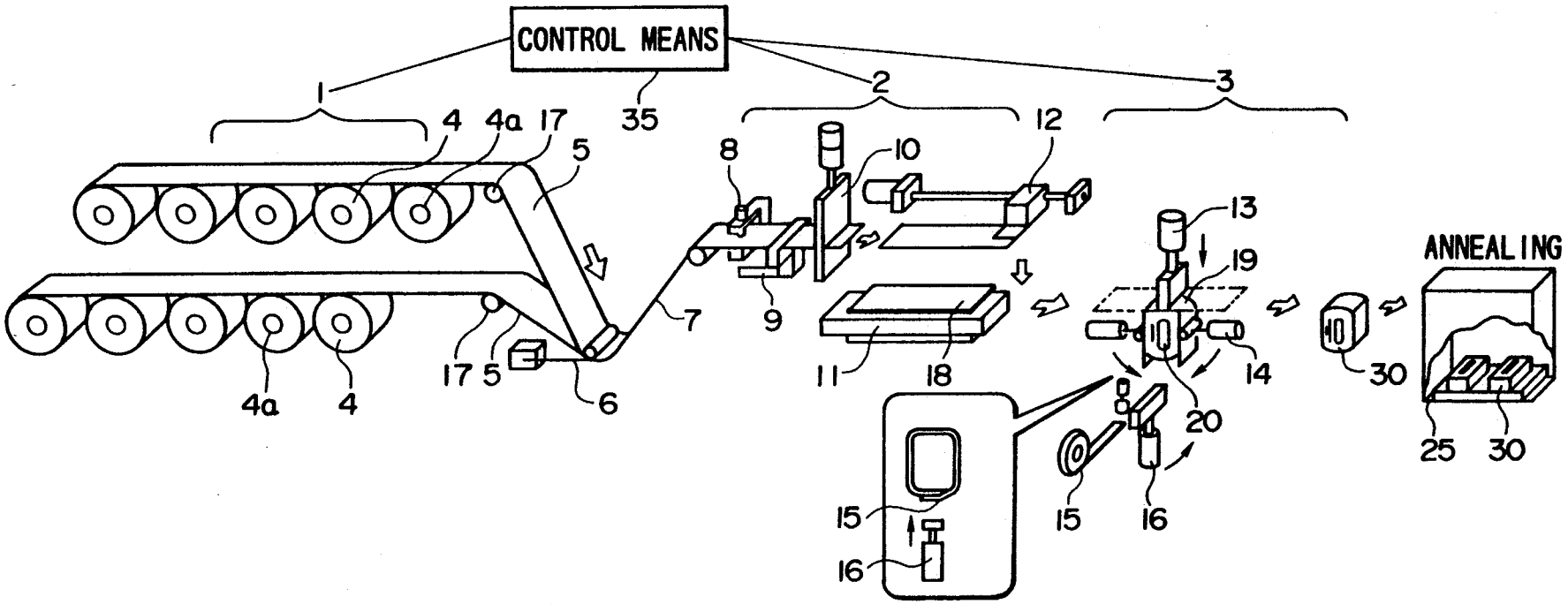
FIG. 1 is a schematic view of a system of an amorphous magnetic core manufacturing apparatus according to one embodiment of the present invention.

FIG. 1 shows a whole system of an apparatus for manufacturing an amorphous magnetic core according to the invention.

Figure 7A:
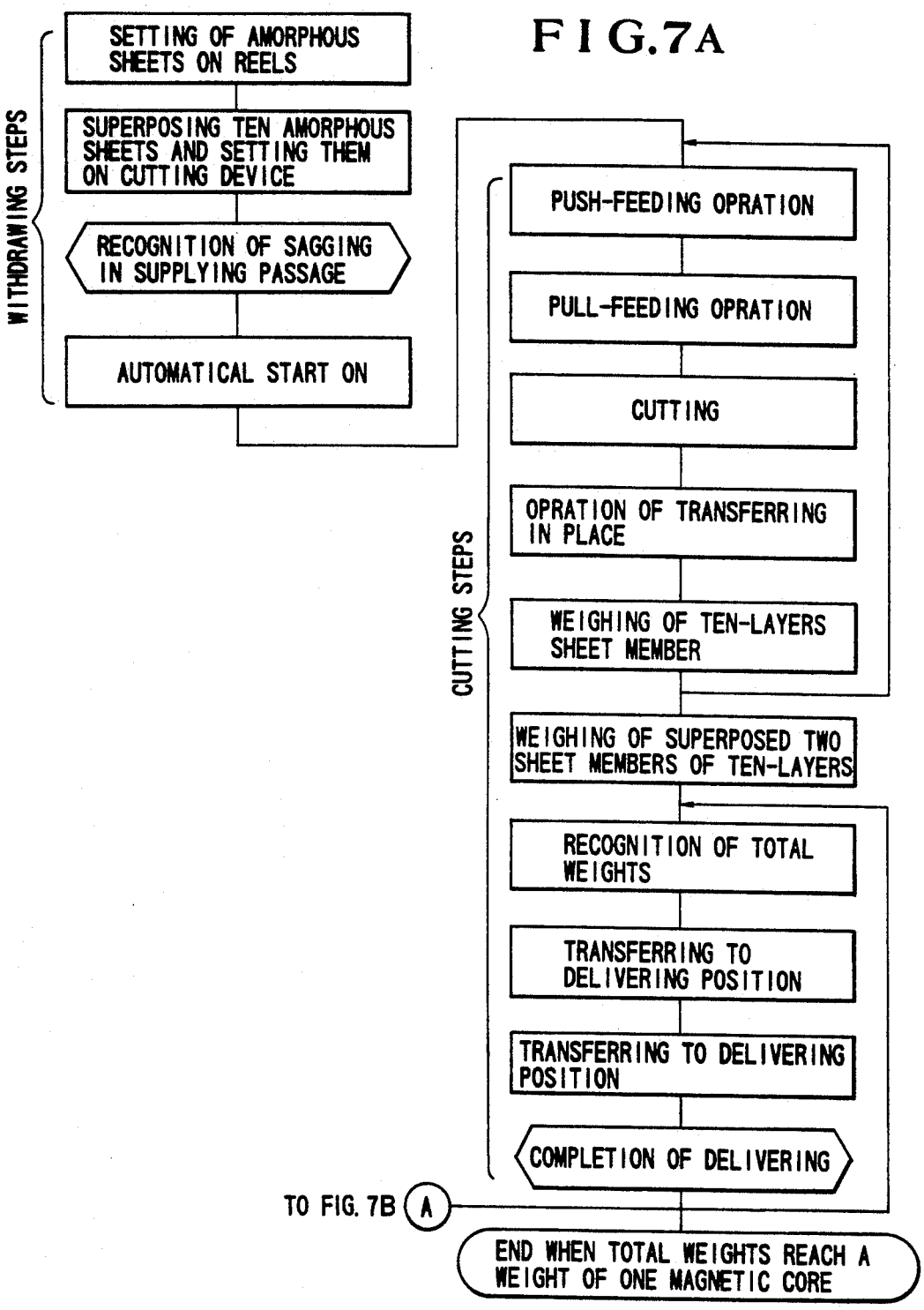
FIGS. 7A and 7B show a procedure of an amorphous magnetic core manufacturing method as an example.
Figure 7B:
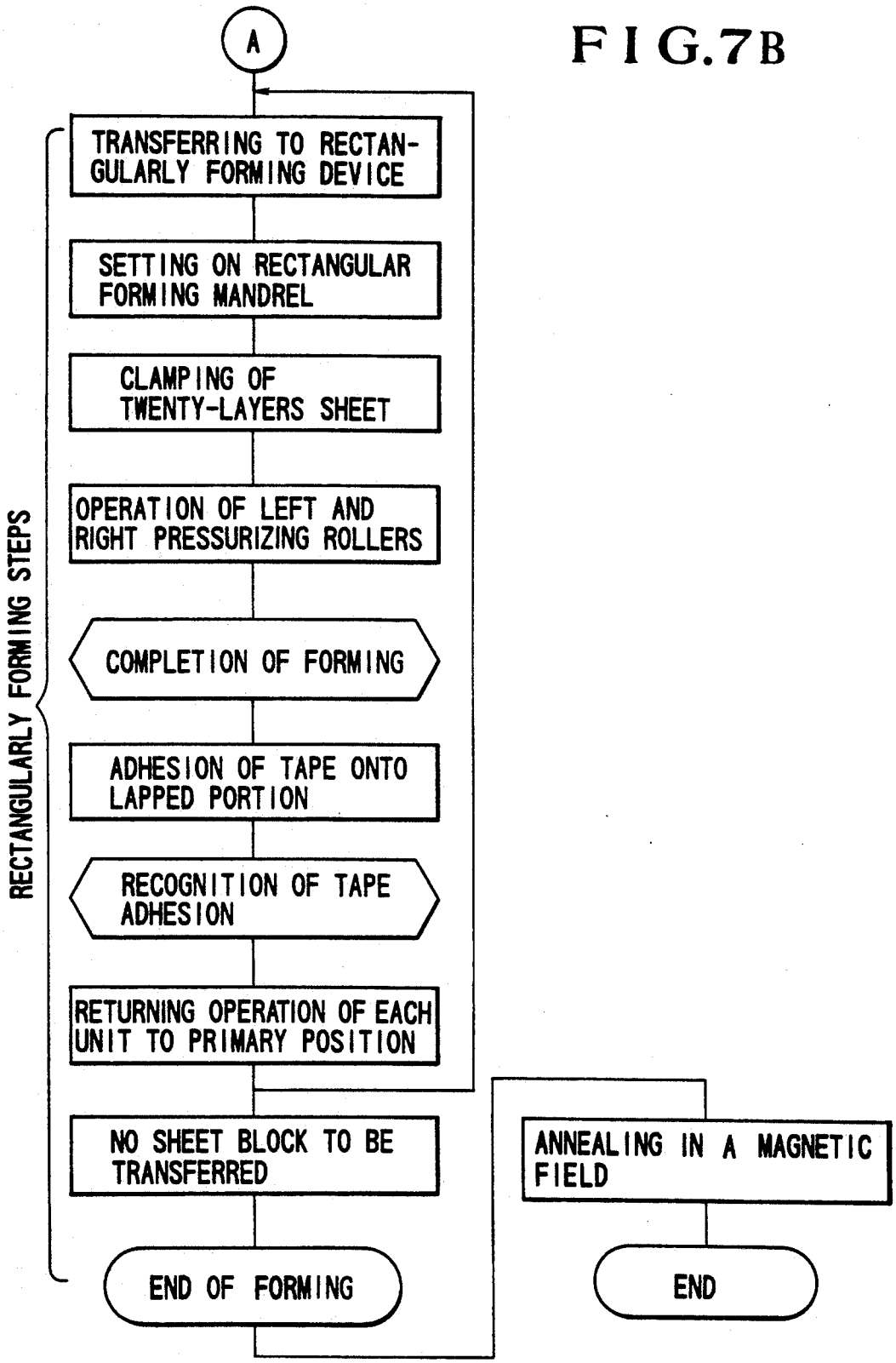

The amorphous magnetic core manufacturing apparatus comprises: an uncoiler device 1 for blank strip sheets of an amorphous metal which are wound around a plurality of reels, to superpose a plurality of the blank sheet materials before supplying them to a subsequent step; a cutter device 2 to cut the plurality of superposed blank amorphous sheets supplied from the uncoiler device 1 to a predetermined length, and to pile up in place the cut amorphous metal sheets having the predetermined length of a predetermined number; a rectangularly forming device 3 for winding the amorphous metal sheets of the predetermined number around a rectangular forming mandrel in order to directly form a magnetic core 30 with a rectangular contour, the amorphous metal sheets having been cut and piled up by the cutter device 2; an annealing device 25 for annealing the formed magnetic core 30 with the rectangular contour, and a control means 35 for controlling relative movements of at least the uncoiler 1 and the cutting device 2. In order to realize a complete automation process, the control means 35 is also arranged to control the rectangularly forming device 3. With the manufacturing system described above, the amorphous magnetic core is produced through procedures shown in FIGS. 7A and 7B.

Then, structures and movements of the respective component parts of the system will be explained.

Figure 2:
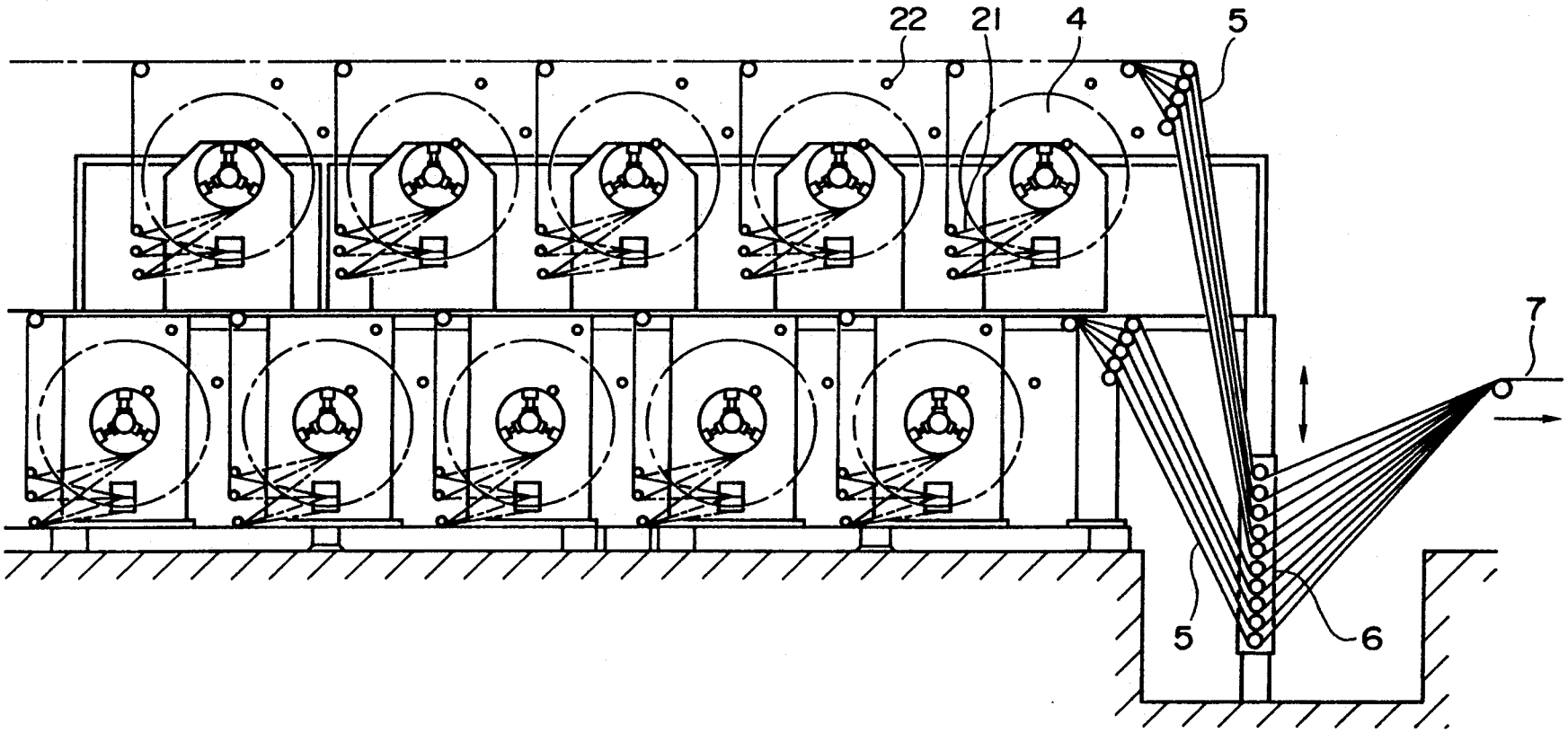
FIG. 2 is a view showing in detail an uncoiler device according to the embodiment of FIG. 1.

As shown in FIG. 2, the uncoiler device 1 with the multiple reels includes a driving source which gives an appropriate amount of sagging to the sheet member 5 at an outlet of the uncoiler device 1, in order to surely supply a constant amount of blank amorphous sheets. The uncoiler device 1 is provided with a detection lever 6 at a position where a number of the blank sheets are superposed, for precisely applying tension to the blank sheets so that the multiple blank sheets 4 are brought into close contact with each other without any gaps existing therebetween.

The uncoiler device 1 pulls the amorphous blank strip-sheets 4 from the reels 4a around which the blank sheets are wound, the reels 4a being five in number at each of two stages, for forming the five-layers sheet member 5 (hereinafter the superposed blank sheets will be referred to as the sheet member). The upper and lower sheet members are further combined into a ten-layers sheet member 7. The detection lever 6 is provided for applying the appropriate amount of sagging to the combined portion of the upper and lower sheet members 5 as well as for giving an adequate tension thereto in order to improve the closeness degree of the laminated sheets. More specifically, to give the optimum tension to the sheet member 7, the apparatus of the invention includes a mechanism for controlling the operation of the uncoiler device 1. FIG. 2 illustrates the uncoiler device 1 in detail. The sagging of the upper and lower five-layers sheet members 5 are absorbed by control levers 21 and resistance occurring when the blank sheets 4 are withdrawn from the reels 4a is regulated by means of regulation levers 22. The sagging detection lever 6 always applies the tension to the sheet member 7 so as to bring the blank amorphous sheets 4 into close contact with each other, without any gaps existing therebetween. In this way, the five-layers sheet members 5 are formed into the ten-layers sheet member 7 which is supplied to the cutter device 2.

It is appropriate that the number of the blank amorphous sheets to be superposed is 5 to 20, for the purpose of reducing variation of the magnetic properties of a magnetic core. If the number of the blank sheets to be superposed is small, a processing efficiency is worse and the effect is insufficient. However, if the number is too large, it becomes difficult to cut the superposed blank sheets and the price of the uncoiler device is increased.

Magnetic properties and qualities of the blank amorphous sheets 4 at the respective reels are greatly different from one another. In case of mass-producing amorphous magnetic cores, it is accordingly hard to control properties of magnetic core products because they vary corresponding to the difference of lots of the blank sheets. In this embodiment, the blank amorphous sheets of the lots different from one another are mounted on the uncoiler device 1. As a result, the laminated sheet member 5 or the sheet member 7 has average properties of the blank sheets, which results in a produced magnetic core with stable properties.

When the blank sheets of relatively low quality are provided on the inner side and the blank sheets of relatively high quality are provided on the outer side, after investigation of the properties of the blank sheets before winding, the properties of the produced magnetic core can be further improved.

Figure 3:
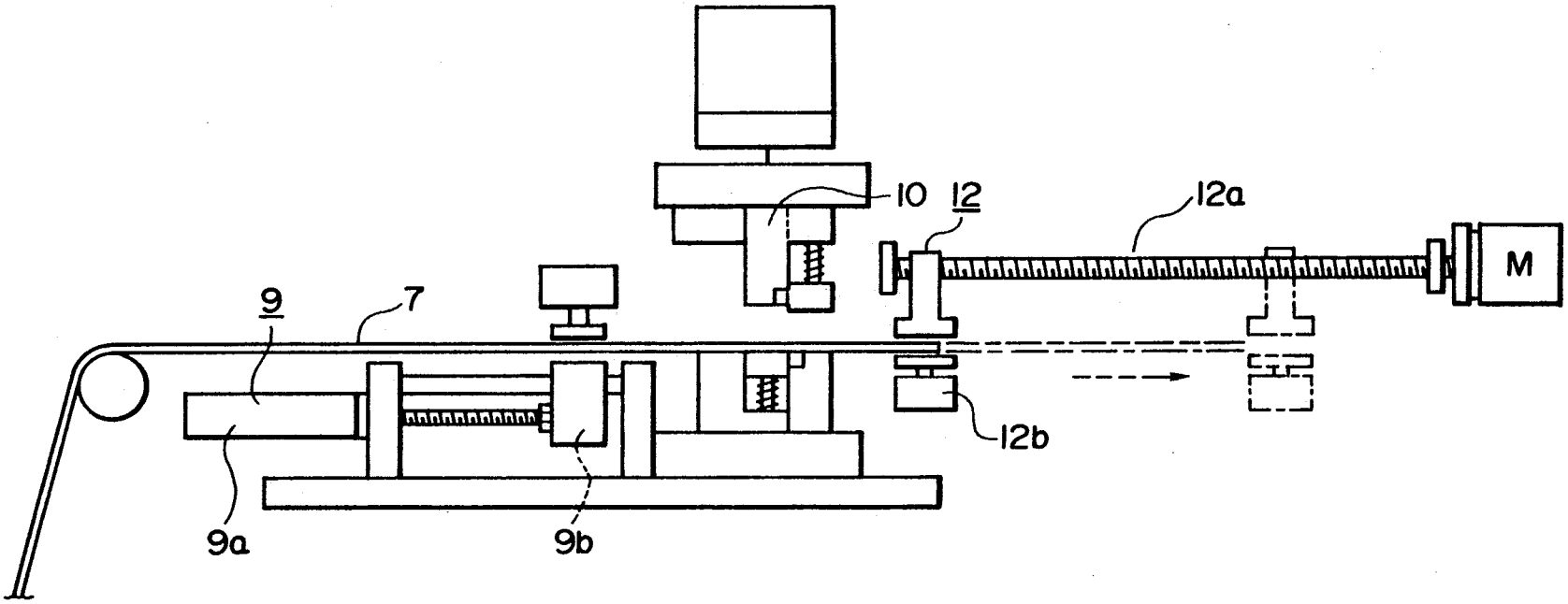
FIG. 3 is a view illustrative of transferring mechanism for work articles of a cutter device in the embodiment.
Figure 4A:
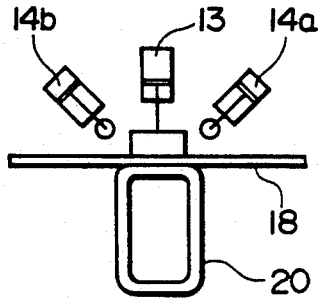
FIGS. 4A to 4E are views for explaining one example of the procedures followed in forming an amorphous magnetic core in the embodiment.
Figure 4B:
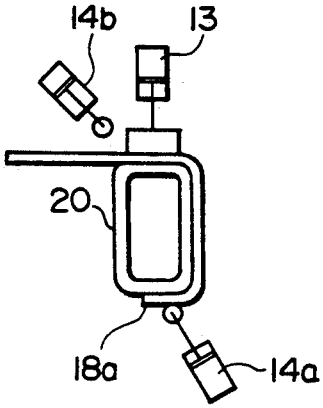
Figure 4C:
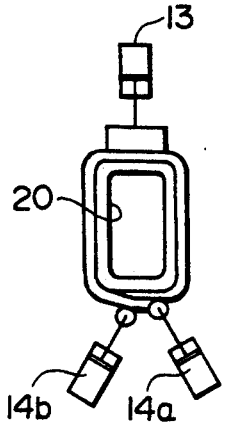
Figure 4D:
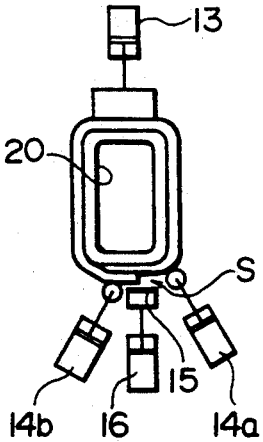
Figure 4E:
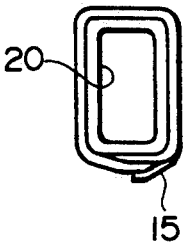
Figure 5A:
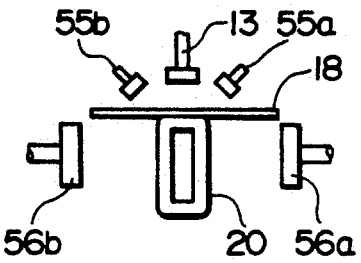
FIGS. 5A to 5J are views for explaining another example of the procedures followed in forming the amorphous magnetic core in the embodiment.
Figure 5B:
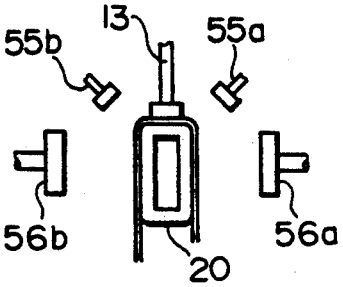
Figure 5C:
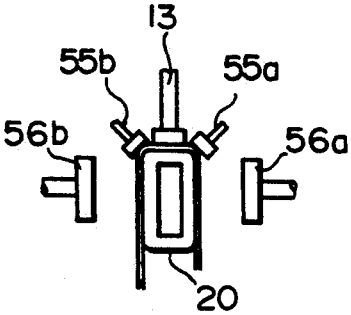
Figure 5D:
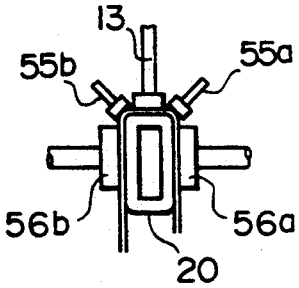
Figure 5E:
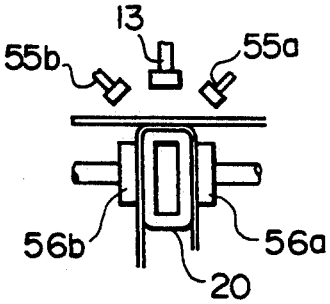
Figure 5F:
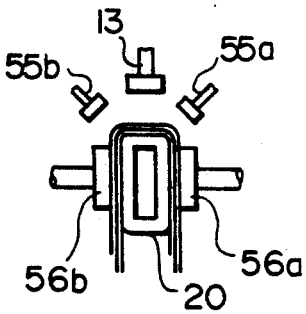
Figure 5G:
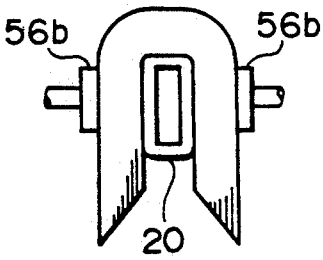
Figure 5H:
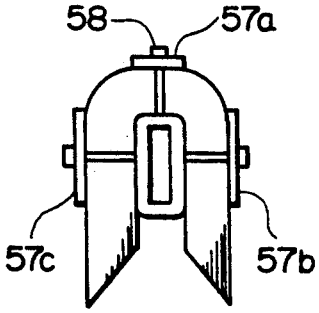
Figure 5I:
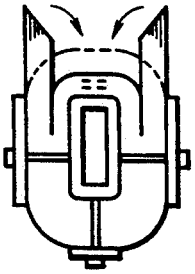
Figure 5J:
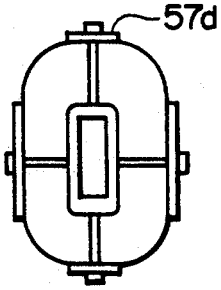

A mechanism for supplying the ten-layers sheet member 7 to the cutter device 2 employs principles of push-feeding and pull-feeding of the thin sheet member. To be concrete, as shown in FIG. 3, a pushing gripper 9*b* of an pushing feeder 9 first clamps the sheet member 7. Subsequently, a pulling gripper 12*b* of a pulling feeder 12 clamps the sheet member 7 whose top end is protruded from a cutter 10. The pulling feeder 12 is arranged to convey the sheet member 7 a long distance. In the drawing, reference 9*a* denotes a cylinder for operating the pushing gripper 9*b* and reference 12*a* a feeder screw for the pulling gripper 12*b*.

The push-feeding method prevents the sheet member from torsion and it also prevents the gripper 12*b* and the cutter 10 from being interfered with each other in the pull-feeding method. The use of the push-feeding method and the pull-feeding method enables the thin sheet member to be transferred smoothly.

As shown in FIG. 1, by a command of the control means 35, a sheet thickness measuring device 8 determines a thickness of the sheet member 7 so as to send a signal of the determined value to the cutter device 2, continuously feeds the sheet member, and controls a cutting length thereof. An error in thickness of the blank amorphous sheets largely affects its dimensional accuracy and the magnetic properties of the produced magnetic core. If the cutting length of the sheet member is decided assuming that the thicknesses of the sheet members are constant, a length of the outer periphery of the wound sheet member on the outermost periphery is largely increased in relation to the length of the circumference of the outermost periphery of the magnetic core, because a radius of winding of the sheet member gradually becomes larger toward the outermost periphery of the magnetic core to be manufactured. In order to manufacture a reliable product, the thickness of the sheet member must be measured with high precision and the cutting length must be decided, taking the measured value of the thickness into consideration.

The continuous ten-layers sheet member is sheared and the separated ten-layers sheet members are stacked with each other to form a twenty-layers laminated block of twenty sheets. This working step is repeatedly carried out. Each block is weighed. This weighing is performed repeatedly so as to sum up the weights of respective blocks until the total amount of the weights reaches a predetermined value of one magnetic core. The weighed blocks are transported to the rectangularly forming device 3 where a magnetic core is formed to have a rectangular outer configuration and a predetermined total weight. More specifically, the ten-layers sheet member 7 sheared by the cutter 10 is laid on a weigher 11 and the subsequent ten-layers sheet member 7 sheared by the second cutting operation of the cutter 10 is stacked on the previously sheared sheet member, the stacked sheet members being supplied, as a twenty-sheets block material 18 having a constant length, to the rectangularly forming device 3 at the downstream-side step by means of supplying means (not shown). Typically, the supplying means is a conveyor or a manipulator.

The block material 18 is conveyed to the rectangularly forming device 3. By a command of the control means 35, a lapped position and width of every block material 18 are determined in accordance with the specification of an iron core to be produced, prior to being extended along a contour of a rectangular forming mandrel 20 and finally formed into a rectangular shape.

The laminated blocks respectively lie on the previously wound block. Both ends of the wound blocks are overlapped with each other. When the block is rectangularly formed by the rectangularly forming device, the respective sheet layers of the block can move freely. At the lapped portion of each block, it is possible to readily absorb a difference between the inner peripheral length and the outer peripheral length of the block, the cut surface at the ends portions of the block is sharp and smooth without remaining burrs. At the same time, there happens no burr at the block ends so that crack defects of products are eliminated.

For the purpose of forming the block material into the rectangular shape, there are two methods: one method is to automatically move pressurizing rollers along the forming mandrel by the command of the control means to fully bend it around the entire surface of the forming mandrel after mounting the block on the forming mandrel; and the other method is to bend the block material into an inverted U-shape along the forming mandrel. In the latter case, a number of blocks are bent and the bent blocks are stacked, one above the other. And then, a manual overlapping operation at the block ends is conducted.

The former method is carried out through steps shown in FIGS. 4A–4E.

Step 1 (FIG. 4A): With use of the rectangular forming mandrel 20, the block material 18 is conveyed to and located at a predetermined position on the forming mandrel 20.

Step 2 (FIG. 4B): After positioning the block material, it is securedly held by means of metal pressers 13 so as not be displaced from the predetermined position. One end portion 18*a* of the block material 18 to be located inside of the lapped portion is first wound around the forming mandrel 20 with the pressurizing roller 14*a*.

Step 3 (FIG. 4C): The other end of the block material 18 is wound around the forming mandrel 20 with the pressurizing roller 14*b*, so that an overlapped portion is formed.

Step 4 (FIG. 4D): After winding, a tape 15 is adhered to the lapped portion s (see FIG. 8) by means of a tape adhesion head 16 while the block material 18 is being pressed by the pressurizing rollers 14*a* and 14*b*.

Step 5 (FIG. 4E): In this way, the block material 18 is mounted on the rectangular mandrel 20.

Thereafter, the subsequent block material 18 is wound around the core so that a lapped portion is located on the top. The respective block material is securely connected at a lapped portion s so as to be formed into a rectangular shape. Thus, it is possible to wind the block material 18 around the forming mandrel in the rectangular shape without the lapped portion being displaced.

The latter method is carried out through steps of FIGS. 5A–5J.

Step 1 (FIG. 5A): With use of the forming mandrel 20, the block material 18 is conveyed to and located at a predetermined position on the forming core 20.

Step 2 (FIG. 5B): After positioning the block material, it is securely held by means of metal pressers 13 so as not be displaced from the predetermined position.

Step 3 (FIG. 5C): Corner portions of the block material 18 are pressed to closely contact with the forming mandrel 20 by means of shoulder pressers 55*a* and 55*b*.

Step 4 (FIG. 5D): Side portions of the block material 18 are pressed to closely contact with the forming mandrel 20 by means of side pressers 56*a* and 56*b*. In this step, the block material 18 is securedly held in such a state that the upper portion and both side portions thereof are in close contact with the forming mandrel 20 so that it is formed in an inverted-U shape.

Step 5 (FIG. 5E): After the step 4 is completed, under such a condition that the side pressers 56*a* and 56*b* press the side portions of the block material, the metal presser 13 and the shoulder pressers 55*a* and 55*b* are released from the block material and the subsequent block material is conveyed and located at the predetermined position on the lower block material. When the metal presser 13 secures the block material again after positioning the block material, the side pressers 56*a* and 56*b* are released so that the block material is set into the state of FIG. 5B (Step 2). Then, the steps 3 and 4 are repeated.

Step 6 (FIG. 5F): After the steps 5, 2, 3 and 4 are completed, under such a condition that the side pressers 56*a* and 56*b* press the side portions of the block material, the metal presser 13 and the shoulder pressers 55*a* and 55*b* are released from the block material, waiting for conveyance of the subsequent block material.

Step 7 (FIG. 5G): The steps 1 to 6 are repeatedly performed for forming the block materials in the inverted U-shape in order to manufacture one iron core.

Figure 6:
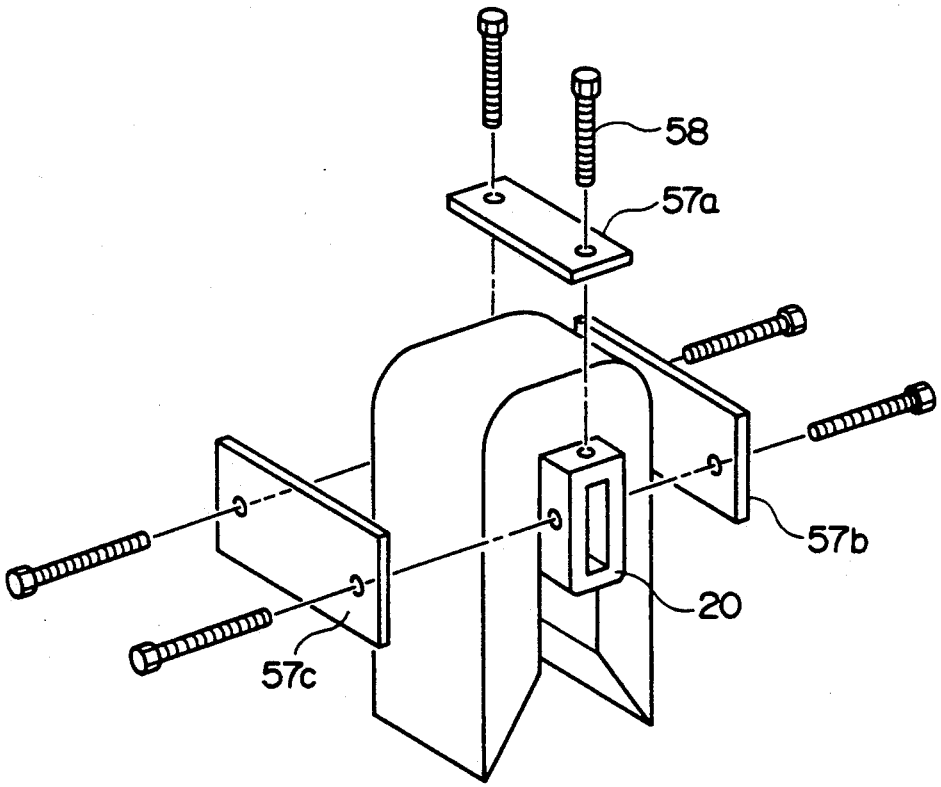
FIG. 6 is an illustration of a clamping manner, in which some clamping plates are used, corresponding to FIG. 5H.

Step 8 (FIG. 5H): After finishing to form all the block materials for a magnetic core product in the inverted U-shape, contact plates 57*a*, 57*b* and 57*c* are secured to the forming mandrel 20 by fastening bolts 58, as shown in FIG. 6.

Step 9 (FIG. 5I): The core 20 is inverted to turn the lapped portion to the upper side thereof. The block materials are lapped at both ends thereof, starting from the innermost block material successively.

Step 10 (FIG. 5J): After completion of the lapping operation, the lapped portions are fixed to the forming mandrel 20 by means of a contact plate 57*d* and a fastening bolt 58. In this state, the magnetic core is supplied to an annealing step.

In this embodiment, the steps 8 to 10 are manually performed. However, they may be carried out automatically by the command of the control means 35 with the manipulator or the like.

In the steps of FIGS. 4A–4E and 5A–5J, even if the lapped portion s is accurately located so as not to displace during winding of the block material, a reference position may vary by erroneous dimension in thickness of the blank sheets 4 and a variation of the space factor in the course of winding a number of the block materials. A countermeasure for this is to decide a cutting length of the sheet member after measuring a thickness of the block material 18 to be subsequently wound and taking the space factor into account, for the rectangular formation of the block material.

One example of a structure of the amorphous magnetic core produced by the above-mentioned steps is shown in FIG. 6.

Figure 8:
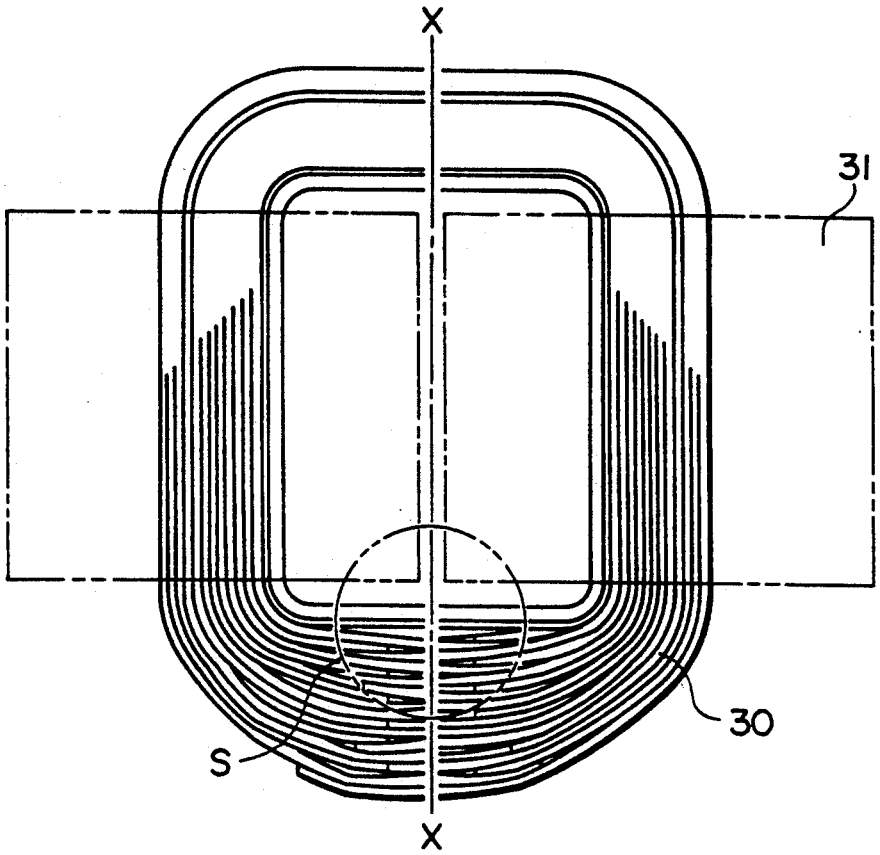
FIG. 8 is a front view of the amorphous magnetic core in the embodiment according to the invention.
Figure 9:
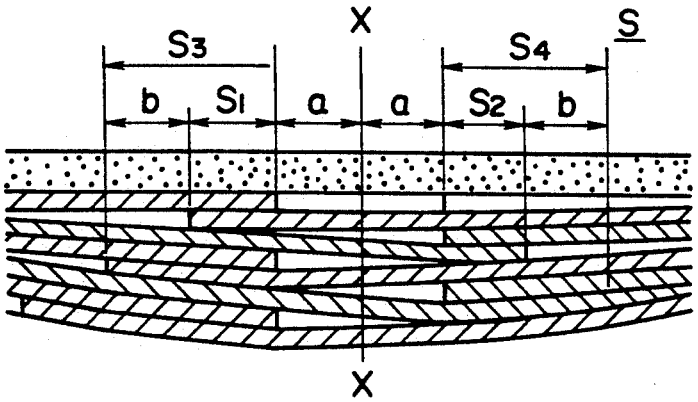
FIG. 9 is an enlarged view of a lapped portion of sheets of the amorphous magnetic core in FIG. 8.

FIG. 8 is a front view of the amorphous iron core 30 manufactured in accordance with the above-described embodiment, in which reference s indicates a lapped end portion and numeral 31 denotes a coil. FIG. 9 is an enlarged view of the lapped portion s, in which each of references $s_1$ to $s_4$ represents a lapped width. This embodiment employs five amorphous magnetic blank-sheets per one block layer. As shown in FIG. 9, the block layers are laminated successively in such a manner that the first block layer on the innermost side and the subsequent block layers include the lapped widths $s_1$, $s_2$, $s_3$, $s_4$, . . . at the lapped portion s, respectively. More specifically, both ends of the first block layer are superposed on each other with the lapped width $s_1$ at a position apart from a symmetrical center line X—X of a yoke portion of the magnetic core by a predetermined distance a. Subsequently, the second block layer is mounted on the first block layer such that both ends of the second block are connected with each other at an extent of the second lapped width $s_2$. One of the ends of each block layer extending toward the X—X line is located at the interval a from such line X—X. The respective ends of the block layers forming the overlapped portion alternately occupy the opposite sides of a plane including the X—X line. The third block layer is mounted on the second block layer at an extent of the third lapped width $s_3$. The end extending toward the X—X line is spaced from the line by the distance a on the same side as the first block layer. The third lapped width $s_3$ is larger than the first lapped width $s_1$. Provided that a difference between the first width $s_1$ and the third width $s_3$ is represented by b, it becomes as follows: $s_3 = s_1 + b$. The fourth block layer is mounted on the third block layer at an extent of the fourth lapped width $s_4$. The end extending toward the X—X line is spaced from the line by the distance a on the opposite side to the third block layer, the fourth lapped width $s_4$ being a total amount of $s_2$ and b.

Additionally, the structure of the amorphous magnetic core formed by the method according to the embodiment is not restricted to the above-described one, but it is possible to modify a structure of the lapped portion by changing the stored program of the control means 35. In this embodiment, the magnetic core with the overlapped structure is obtained by predetermining the lapped widths at the lapped portion to be positive values, whereas if the lapped widths are predetermined to be negative values, a magnetic core with a butted structure can be gained.

As mentioned above, according to the embodiment, because the respective blocks are independently wound around the forming mandrel 20 for forming the magnetic core, the two forming steps in the prior art are reduced to one, thereby manufacturing the magnetic core with a high accuracy. The operation from the step of supplying the materials to the step of forming them rectangularly are carried out mechanically under a condition of a normal temperature, and there are no steps of heating and cooling. Therefore, it is possible to reduce the energy consumption and the number of steps for manufacturing the iron core.

Description concerning the annealing step will be given below.

The rectangularly formed magnetic core 30 is arranged to be subjected to annealing in a magnetic field by an annealing device 25. The magnetic core is annealed for generally two hours at a low temperature not more than 380° C., in order to stabilize the magnetic character and the mechanical properties of the materials. The annealing device 25 is designed such that a plurality of magnetic cores 30 can be annealed simultaneously, as shown in FIG. 1. A coil of at least one turn is wound around the magnetic core 30, which magnetic core is energized during annealing or during gradually cooling after annealing by a direct current.

As set forth so far, according to the present invention, in the step of withdrawing from the uncoiler device, the thin and elongated blank amorphous sheets are supplied easily; in the cutting step, the amorphous sheets are smooth at their cut ends because they are shared by the cutter so that the space factor and the magnetic properties of the magnetic core are excellent; and in the rectangularly forming step, the materials are rectangularly wound around the forming mandrel so that the lapped portion s is formed with high precision. The conventional two steps can be reduced to one, thereby improving an efficiency. The invention can flexibly cope with manufacturing a rectangular magnetic core with a different specification.

Further, because the amorphous sheets which have been cut, can directly be formed into a rectangular shape, the number of the devices is decreased, which results in a reduction of the investment and the space for the devices. Incidentally, since such a toxic substance as an adhesive agent is not used, the method and apparatus according to the invention are superior in safety.

What is claimed is:

1. A method of manufacturing an amorphous magnetic core comprising the steps of:

in an uncoiler device, arranging a plurality of amorphous sheets having different degrees of relative magnetic quality to be respectively wound around a plurality of reels;

withdrawing said plurality of amorphous sheets from said reels;

bringing said plurality of amorphous sheets into close contact with one another to form a stack of said amorphous sheets so arranged that the amorphous sheets are stacked in an order of the degree of relative magnetic quality from low to high;

measuring a thickness of said stack and determining a cutting length of said stack with respect to the measured thickness;

cutting said stack in accordance with the determined length to obtain a cut stack of the amorphous sheets;

supplying the cut stack to a rectangular forming mandrel so that the low degree of magnetic quality side of the cut stack of said amorphous sheets is brought into contact with a first surface of said forming mandrel;

fixing the cut stack on the first surface of said rectangular forming mandrel at a predetermined position;

first press-forming the cut stack around the first surface of the mandrel to contact two adjacent side surfaces of said rectangular forming mandrel to form a U-shape block of the cut stack;

securing said U-shape block onto said rectangular forming mandrel;

bending both free end portions of the U-shape block on said rectangular forming mandrel by a second press-forming step to form a closed rectangular block integrally surrounding said forming mandrel;

securing the bent free end portions of the closed rectangular block onto the rectangular forming mandrel; and annealing said rectangular magnetic core.

2. A method of manufacturing an amorphous magnetic core according to claim 1, further comprising a step intermediate between said cutting step and said supplying step of storing the cut stack in a predetermined location so that said supplying supplies the cut stack from said predetermined location.

3. A method of manufacturing an amorphous magnetic core according to claim 2, further comprising said first surface of said forming mandrel being an upper horizontal surface and said side surfaces being vertical with respect to said upper horizontal surface such that said first press-forming step forms the cut stack around the upper horizontal and vertical side surfaces of said rectangular forming mandrel to form the U-shape block, inverted with respect to the upper horizontal surface of the mandrel; and intermediate of said securing and said bending steps, turning over said inverted U-shape block and said rectangular forming mandrel so that said second press-forming step presses vertically downwardly the free end portions of the U-shape block against a side of the forming mandrel opposite to said upper horizontal surface.

4. A method of manufacturing an amorphous magnetic core according to claim 1, wherein said fixing step includes centrally positioning the cut stack with respect to a center point of the first surface of said rectangular forming mandrel prior to said first press-forming step.

5. A method of manufacturing an amorphous magnetic core according to claim 1, wherein said bending step includes overlapping said free end portions of the U-shape block so that an overlapped portion is formed.

6. A method of manufacturing an amorphous magnetic core according to claim 5, further including adhering the overlapped portions with adhesive tape prior to said annealing.

* * * * *